US006438808B1

(12) United States Patent
Kung

(10) Patent No.: US 6,438,808 B1
(45) Date of Patent: Aug. 27, 2002

(54) FASTENER

(75) Inventor: Tsung-Min Kung, Kaohsiung (TW)

(73) Assignee: Taiwan Industrial Fastener Corporation, Taipei (TW)

( * ) Notice: Subject to any disclaimer, the term of this patent is extended or adjusted under 35 U.S.C. 154(b) by 0 days.

(21) Appl. No.: 09/901,723

(22) Filed: Jul. 11, 2001

(51) Int. Cl.[7] ..... A44B 21/00; A41F 1/00; A45F 5/08

(52) U.S. Cl. ..... 24/572.1; 24/3.11; 24/3.12; 24/573.09; 24/578.1

(58) Field of Search ..... 24/572.1, 573.09, 24/574.1, 578.1, 3.11, 3.12

(56) References Cited

U.S. PATENT DOCUMENTS

| | | | | |
|---|---|---|---|---|
| 4,356,943 A | * | 11/1982 | Berman | 224/222 |
| 4,881,150 A | * | 11/1989 | Oyamada | 24/3.12 |
| 5,540,368 A | * | 7/1996 | Oliva | 224/271 |
| 5,584,423 A | * | 12/1996 | Wang | 224/197 |
| 5,996,184 A | * | 12/1999 | Mah et al. | 24/3.12 |
| 6,038,742 A | * | 3/2000 | Patterson | 24/3.12 |
| 6,149,043 A | * | 11/2000 | Goto | 24/3.11 |

FOREIGN PATENT DOCUMENTS

| | | | | |
|---|---|---|---|---|
| CH | 0445953 | * | 3/1968 | 24/572.1 |
| GB | 2204086 | * | 11/1988 | 24/3.12 |
| JP | 8219405 | * | 12/1983 | 24/3.11 |

* cited by examiner

*Primary Examiner*—Victor Sakran
(74) *Attorney, Agent, or Firm*—Rabin & Berdo, P.C.

(57) ABSTRACT

A fastener includes a male fastening member having a springy hook plate and a retaining block and a stop block, and a female fastening member having a hook hole and a retaining hole and a recessed bearing portion. The retaining block and the stop block are forced into engagement with the retaining hole and the recessed bearing portion when hooking the springy hook in the hook hole. Turning the male fastening member outwards from the female fastening member to disengage the retaining block from the retaining hole enables the male fastening member to be separated from the female fastening member.

5 Claims, 4 Drawing Sheets

FASTENER

BACKGROUND OF THE INVENTION

The present invention relates to a fastener and, more particularly, to such a fastener, which is comprised of a female fastening member and a male fastening member adapted to be hooked in the female fastening member or directly hung on the user's waist belt.

Every people may carry a number of personal items (key chain, cellular telephone, suitcase, and etc.) when traveling or going to the outside. These personal items may be equipped with fastening means for fastening to the user's waist belt or other objects. FIG. 7 shows a fastener for this purpose. As illustrated, the fastener comprises a hook plate A1 pivoted to a first object, for example, a cellular telephone A, and a hollow locating block B fixedly fastened to a second object, for example, a suitcase C. The hollow locating block B has two mounting lugs B1 extended from two sides thereof and respectively fastened to one side panel of the suitcase C by a respective screw. The hook plate A1 has fixed end pivoted to the back sidewall of the cellular telephone A and supported on a torsional spring, and a free end terminating in an inwardly curved hook portion A2. After insertion of the hook plate A1 into the hollow locating block B, the hooked portion A2 is forced to hook the bottom edge of the hollow locating block B. This design of fastener is still not satisfactory in function because of the following drawbacks:

1. Because the hook plate A1 is pivoted to the back sidewall of the cellular telephone A by pivot means and supported on a torsional spring, the installation of the hook plate A1 is complicated.
2. It is inconvenient to disengage the hook plate A1 from the hollow locating block B.
3. Because the free end of the hook plate A1 is curved inwards, the hollow locating block B must have a certain thickness so that the hook plate A1 can be inserted through the through hole defined in the hollow locating block B to hook up with the bottom edge of the hollow locating block B.
4. The hook plate A1 must fit the hollow locating block B perfectly, preventing vibration of the hook plate A1 relative to the hollow locating block B.

SUMMARY OF THE INVENTION

The present invention has been accomplished to provide a fastener, which eliminates the aforesaid drawbacks. According to one aspect of the present invention, the fastener comprises a male fastening member and a female fastening member respectively injection-molded from plastics and fastened to two objects by stitches, for enabling the two objects to be detachably fastened together. According to another aspect of the present invention, the female member comprises a retaining block and a springy hook plate disposed at different elevations and a stop block spaced between the retaining block and the hook plate, and the female fastening member comprises a hollow positioning block defining a hook hole, a retaining hole, and a recessed bearing portion for engagement with the hook plate, retaining block and stop block of the male fastening member. When hooking the springy hook plate of the male fastening member in the hook hole of the female fastening member, the retaining block and stop block of the male fastening member are respectively forced into engagement with the retaining hole and recessed bearing portion of the female fastening member. The male fastening member is disconnected from the female fastening member when turned outwards from the female fastening member to disengage the retaining block from the retaining hole and then pulled upwards relative to the female fastening member.

DETAILED DESCRIPTION OF THE PREFERRED EMBODIMENT

Figure 1:
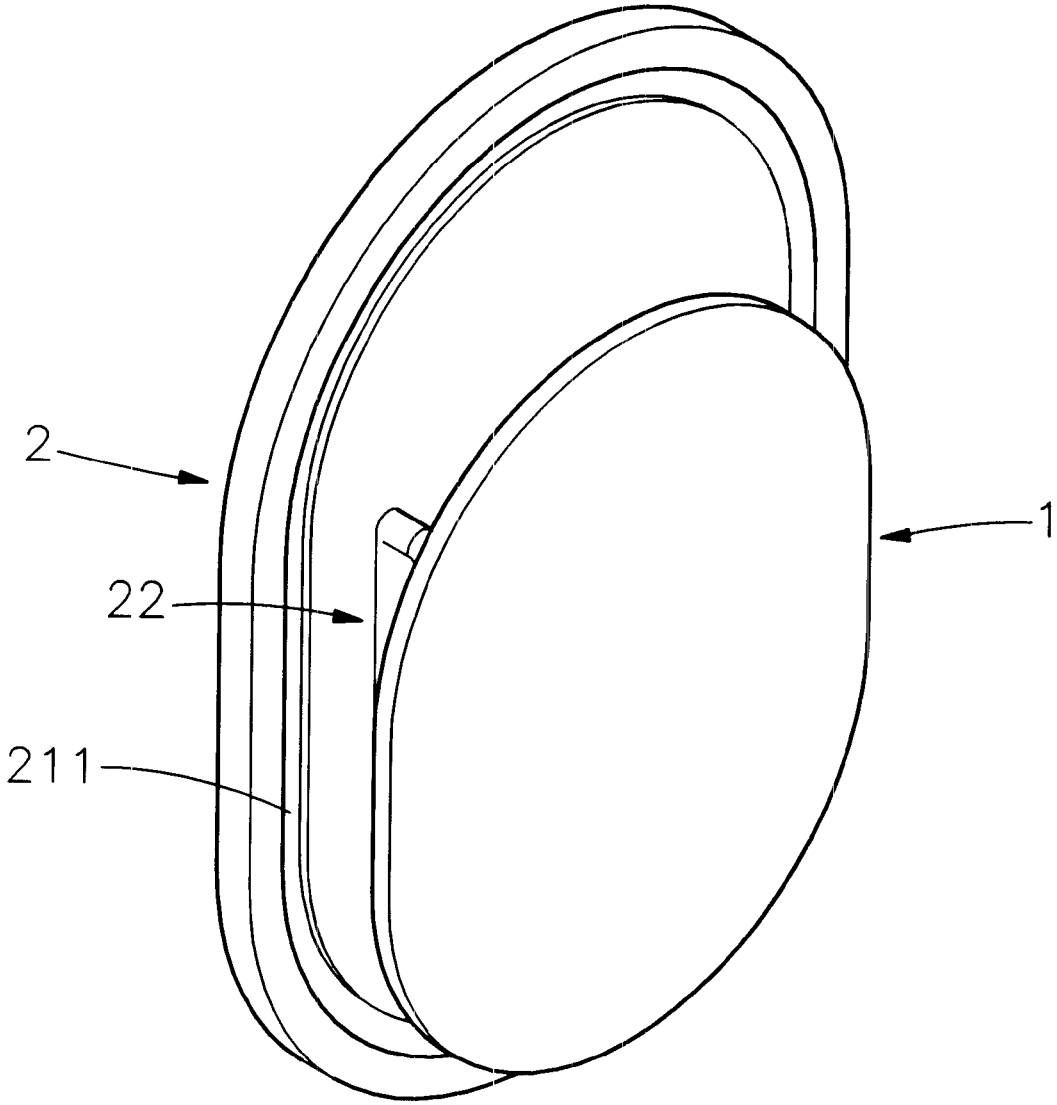
FIG. 1 is an elevational view of a fastener according to the present invention.
Figure 3:
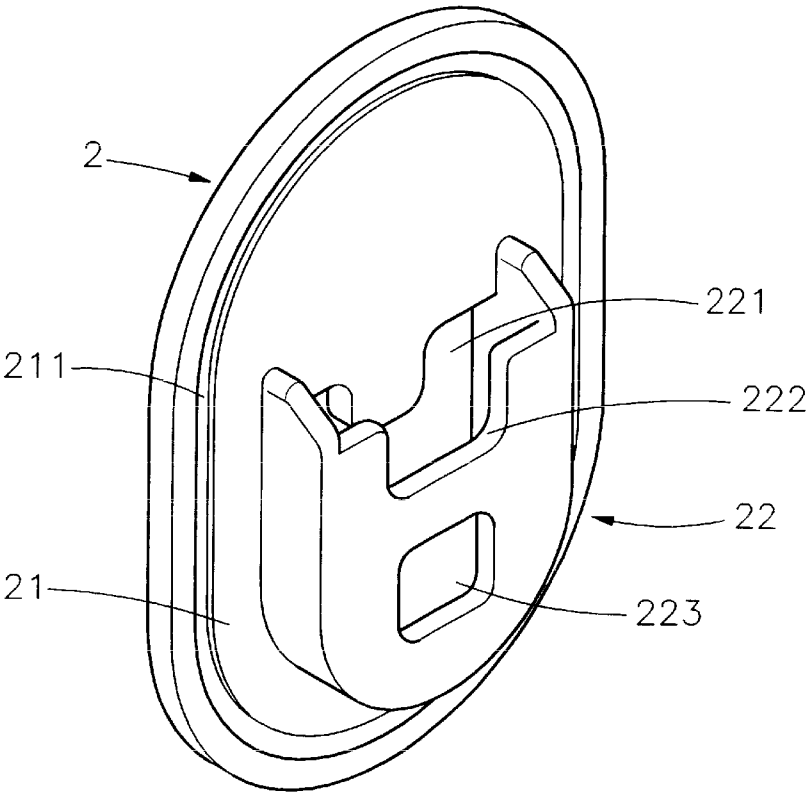
FIG. 3 is a perspective view of the female fastening member for the fastener according to the present invention.
Figure 2:
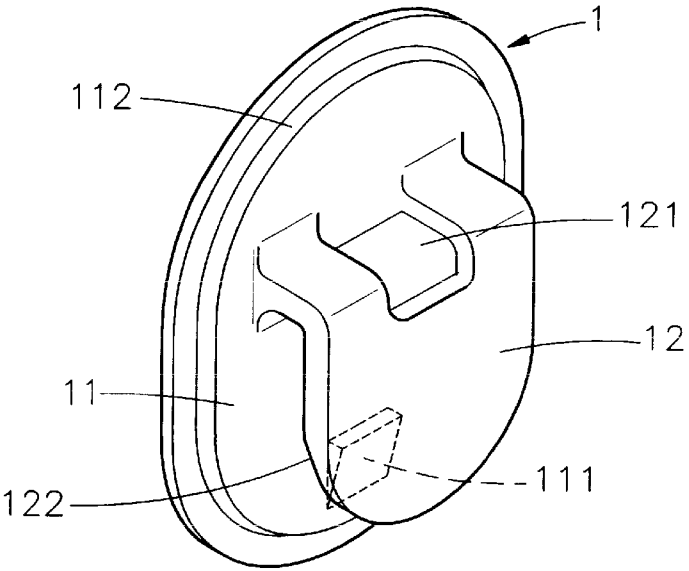
FIG. 2 is a perspective view of the male fastening member for the fastener according to the present invention.

Referring to FIGS. From 1 through 3, a fastener in accordance with the present invention is shown comprised of a male fastening member 1 and a female fastening member 2. The male fastening member 1 comprises a flat base 11, a retaining block 111 and a springy hook plate 12 respectively extended from one side, namely, the front side of the flat base 11 at different elevations, a mounting flap 112 extended around the periphery of the flat base 11 and disposed in flush with the other side, namely, the back side of the flat base 11 for fastening to a first device by stitches, and a stop block 121 extended from the front side of the flat base 11 between the hook plate 12 and the retaining block 111. The hook plate 12 has a free end terminating in beveled guide face 122. The female fastening member 2 comprises a flat base 21, a mounting flap 211 extended around the periphery of the flat base 21 and disposed in flush with one side, namely, the back side of the flat base 21 for fastening to a second device by stitches, and a hollow positioning block 22 integral with one side, namely, the front side of the flat base 21 for engagement with the male fastening member 1. The hollow positioning block 22 comprises a hook hole 221 adapted to receive the hook plate 12 of the male fastening member 1, a retaining hole 223 disposed in communication with the hook hole 221 and adapted to receive the retaining block 111 of the male fastening member 1, and a recessed locating portion 222 disposed above the retaining hole 223 and adapted to bear the stop block 121 of the male fastening member 1.

Figure 6:
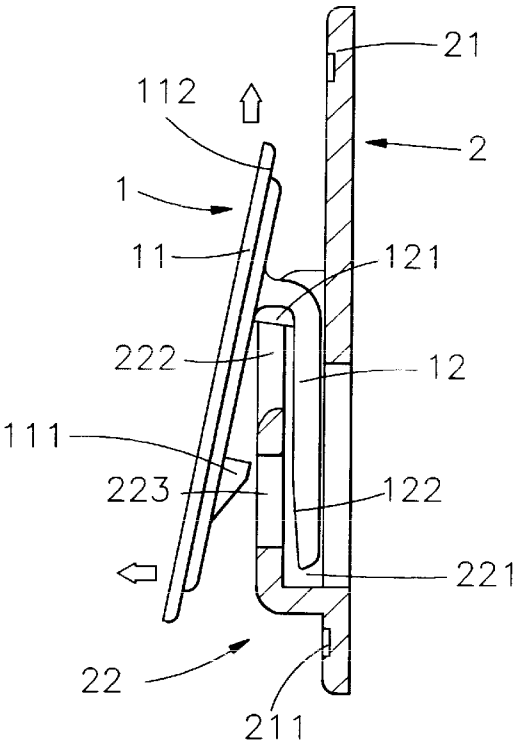
FIG. 6 is a sectional view of the present invention showing the male fastening member turned outwards from the female fastening, the retaining block disengaged from the retaining hole.
Figure 5:
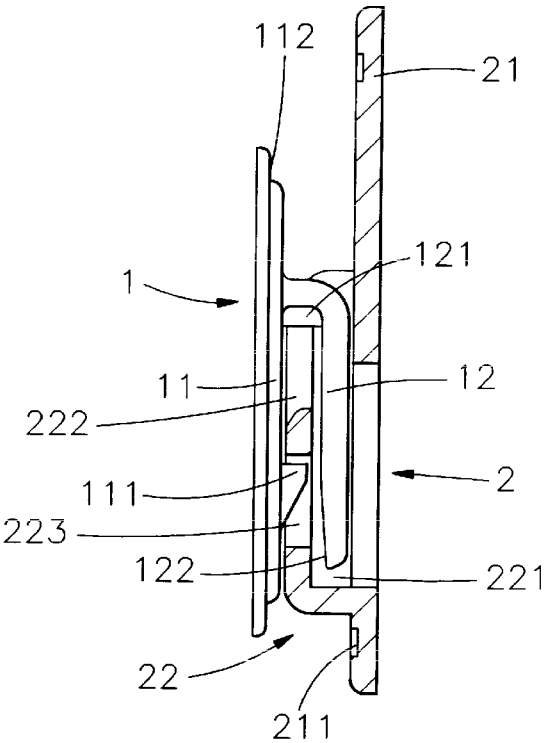
FIG. 5 is a sectional view of the present invention showing the male fastening member and the female fastening member fastened together.
Figure 4:
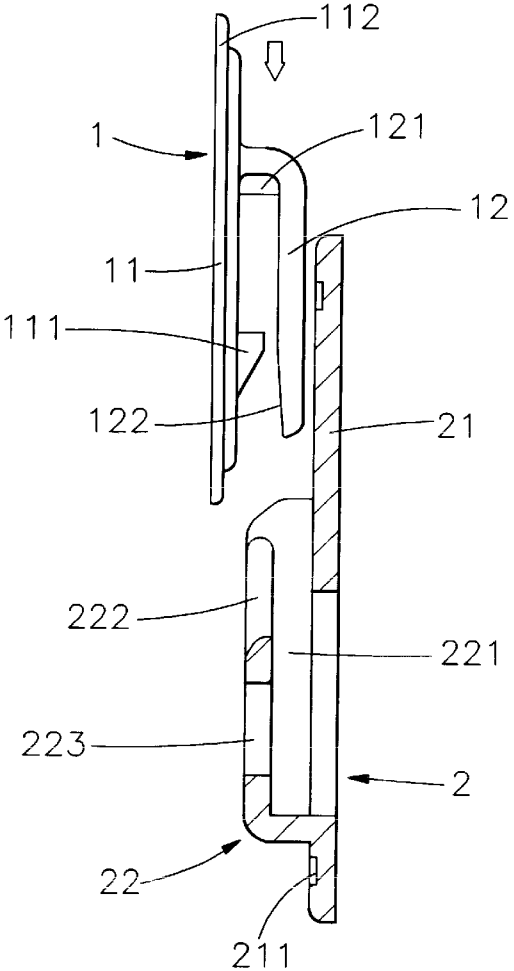
FIG. 4 is a sectional view of the present invention showing the hook plate of the male fastening member aimed at the hook hole of the female fastening member.
Figure 7:
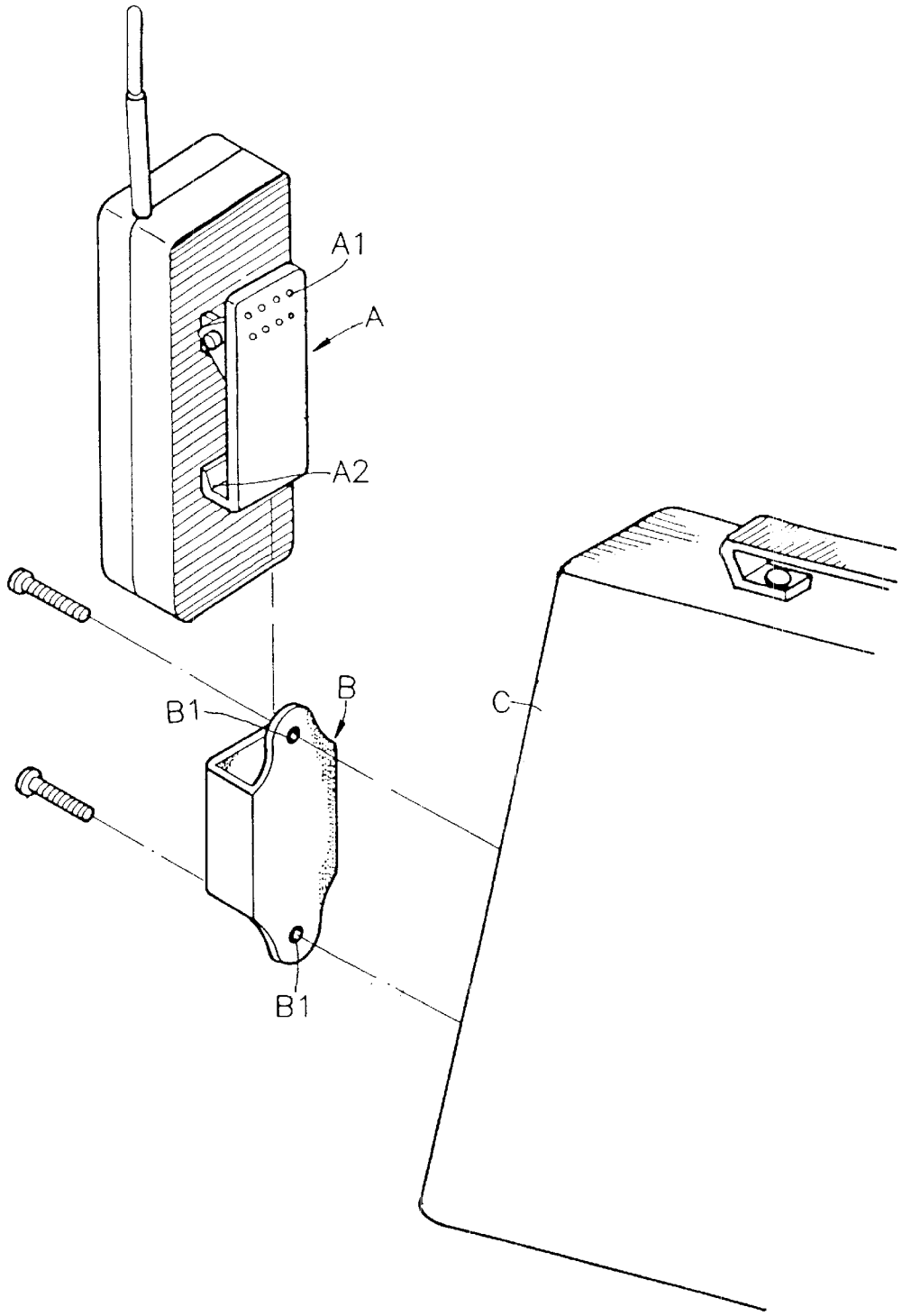
PRIOR ART FIG. 7
FIG. 7 is an exploded view of a fastener constructed according to the prior art.

Referring to FIGS. From 4 through 6, when in use, the male fastening member 1 and the female fastening member 2 are respectively fastened to two devices (not shown) by stitches, for enabling the two devices to be detachably fastened together. When fastening the two devices, the hook plate 12 of the male fastening member 1 is inserted into the hook hole 221 of the hollow positioning block 22 of the female fastening member 2 (see FIG. 4). By means of the beveled guide face 122, the hook plate 12 can easily be inserted into the hook hole 221. After insertion of the hook plate 12 into the hook hole 221, the retaining block 111 and stop block 121 of the male fastening member 1 are respectively forced into engagement with the retaining hole 223 and recessed locating portion 222 of the female fastening member 2 to positively secure the male fastening member 1 and the female fastening member 2 together (see FIG. 5). When separating the two devices from each other, the male fastening member 1 is turned outwards from the female fastening member 2 through an angle to disengage the retaining block 111 from the retaining hole 223 (see FIG. 6), and then the male fastening member 1 is pulled upwards to disengage the hook plate 12 and the stop block 121 from the hook hole 221 and the recessed bearing portion 222, and thus the male fastening member 1 and the female fastening member 2 are set apart.

Further, the male fastening member 1 can be separately used and fastened to the peripheral edge of an object. In this case, the hook plate 112 and the retaining block 111 work as a device clip to secure the male fastening member 1 to the peripheral edge of the object.

According to the present invention, the male fastening member 1 and the female fastening member 2 are respectively injection-molded from plastics so that the fabrication procedure of the fastener is simplified and, the manufacturing cost of the fastener is greatly reduced. The fastening and unfastening procedures of the fastener are simple. When hooking the hook plate 12 of the male fastening member 1 into the hook hole 221 of the hollow positioning block 22 of the female fastening member 2, the retaining block 111 and stop block 121 of the male fastening member 1 are automatically forced into engagement with the retaining hole 223 and recessed bearing portion 222 of the female fastening member 2. On the contrary, when turning male fastening member 1 outwards from the female fastening member 2, the retaining block 111 is disengaged from the retaining hole 223, for enabling the male fastening member 1 to be removed from the hollow positioning block 22 of the female fastening member 2 directly. Further, because the stop block 121 and retaining block 111 are respectively forced into engagement with the recessed positioning portion 222 and retaining hole 223 of the hollow positioning block 22 after hooking of the hook plate 12 in the hook hole 221 of the hollow positioning block 22, the connection between the male fastening member 1 and the female fastening member 2 is stable.

While only one embodiment of the present invention has been shown and described, it will be understood that various modifications and changes could be made thereunto without departing the spirit and scope of the invention disclosed.

What the invention claimed is:

1. A fastener comprising:

a male fastening member, said male member comprising a mounting base, and a retaining block and a springy hook plate respectively extended from a front side of the flat base of said male fastening member at different elevations; and a female fastening member, said female fastening member comprising a flat base, and a hollow positioning block integral with a front side of the flat base of said female fastening member for engagement with said male fastening member, said hollow positioning block comprising a hook hole adapted to receive the springy hook plate of said male fastening member, and a retaining hole disposed in communication with said hook hole and adapted to receive the retaining block of said male fastening member.

2. The fastener of claim 1 wherein said male fastening member further comprises a stop block extended from the front side of the flat base of said male fastening member and between said springy hook plate and said retaining block, and said hollow positioning block of said female fastening member further comprises a recessed locating portion disposed above said retaining hole and adapted to bear the stop block of said male fastening member after insertion of said springy hook plate in said hook hole.

3. The fastener of claim 1 wherein said male fastening member further comprises a mounting flap extended around the periphery of the flat base thereof for fastening to an object by stitches.

4. The fastener of claim 1 wherein said female fastening member further comprises a mounting flap extended around the periphery of the flat base thereof for fastening to an object by stitches.

5. The fastener of claim 1 wherein said male fastening member and said female fastening member are respectively injection-molded from plastics.

* * * * *